US007631374B2

(12) United States Patent
Paoutoff

(10) Patent No.: US 7,631,374 B2
(45) Date of Patent: Dec. 15, 2009

(54) COLLAPSIBLE FURNITURE CONSTRUCTION, PARTICULARLY FOR A FOLDAWAY BED

(76) Inventor: Alexis Paoutoff, RN 352, 38680 Saint Just de Claix (FR)

( * ) Notice: Subject to any disclaimer, the term of this patent is extended or adjusted under 35 U.S.C. 154(b) by 225 days.

(21) Appl. No.: 10/592,069

(22) PCT Filed: Mar. 7, 2005

(86) PCT No.: PCT/FR2005/000540

§ 371 (c)(1),
(2), (4) Date: Nov. 17, 2006

(87) PCT Pub. No.: WO2005/087053

PCT Pub. Date: Sep. 22, 2005

(65) Prior Publication Data

US 2008/0229497 A1 Sep. 25, 2008

(30) Foreign Application Priority Data

Mar. 9, 2004 (FR) ..... 04 02428

(51) Int. Cl.
*A47C 17/38* (2006.01)

(52) U.S. Cl. ..... 5/136

(58) Field of Classification Search ..... 5/136, 5/137, 139, 163, 162, 167, 159.1, 133, 164.1, 5/166.1, 2.1

See application file for complete search history.

(56) References Cited

U.S. PATENT DOCUMENTS

| | | | | | |
|---|---|---|---|---|---|
| 4,476,592 | A * | 10/1984 | Reppas et al. | ..... | 5/164.1 |
| 4,553,278 | A * | 11/1985 | Drexhage | ..... | 5/136 |
| 5,101,523 | A * | 4/1992 | Bright | ..... | 5/2.1 |
| 5,353,452 | A * | 10/1994 | Rulis | ..... | 5/136 |
| 5,446,932 | A * | 9/1995 | Voorhis | ..... | 5/137 |
| 5,621,930 | A | 4/1997 | Reppas | | |
| 5,978,988 | A * | 11/1999 | Burchett | ..... | 5/136 |
| 6,405,392 | B2 * | 6/2002 | Schwalbe, Jr. | ..... | 5/136 |
| 2002/0088052 | A1 * | 7/2002 | Vilsmeier | ..... | 5/133 |
| 2005/0055770 | A1 * | 3/2005 | Reppas et al. | ..... | 5/136 |
| 2005/0172403 | A1 * | 8/2005 | Darling et al. | ..... | 5/509.1 |

FOREIGN PATENT DOCUMENTS

FR 1 491 279 11/1967

* cited by examiner

*Primary Examiner*—Robert G Santos
*Assistant Examiner*—Brittany M Wilson
(74) *Attorney, Agent, or Firm*—Young & Thompson

(57) ABSTRACT

A collapsible furniture construction includes a holder with two substantially rectangular mutually spaced parallel side flanges with two lower corners at the front and back, upper corners at the front and back and a substantially rectangular pivotable frame with a rear end portion inserted between the flanges and rotatable thereon between a substantially vertical stowed position and a substantially horizontal extended or forwardly open position, including at least one cross-member substantially perpendicular to the flanges and attached thereto for engaging a wall or the floor. The cross-member includes wall or floor attachment elements; a transverse pivot shaft substantially perpendicular to the flanges and mounted on the frame with the shaft ends pivotably connected to the flanges in an area adjacent to the upper front corners thereof; and a twist-preventing reinforcing crossbar substantially perpendicular to the flanges, rigidly connected thereto and positioned in the area below the pivot shaft.

20 Claims, 8 Drawing Sheets

COLLAPSIBLE FURNITURE CONSTRUCTION, PARTICULARLY FOR A FOLDAWAY BED

FIELD OF THE INVENTION

The invention relates to furniture and more particularly to foldaway beds.

BACKGROUND OF THE INVENTION

To improve the living environment, modern furniture has to meet criteria of functionality, simplicity and safety in less and less space. In particular, in the hotel field, bedrooms are rather small and are required simultaneously to offer sleeping space and working space allowing the use of, for example, computers. This observation has prompted the development of foldaway furniture allowing valuable space to be saved depending on their position.

In the hotel field, therefore, it is known practice to use foldaway beds which fold up when not in use in order to allow a valuable amount of space after converting the sleeping space into a working space. A conventional foldaway bed comprises a supporting structure of box type fixed to a wall and comprising two side walls and an upper horizontal wall. The bed is pivoted to the bottom part of this box using an appropriate mounting and hinging arrangement. The foldaway bed is movable between two positions, namely a folded position, in which the bed is arranged vertically inside the box, and an open position, in which the bed rests horizontally on the floor. The foldaway bed is also usually furnished with an element of decor so that in its folded position the box gives the external appearance, for example, of a wardrobe.

However, such foldaway beds are visually unattractive: when the bed is in the open position the sides and top of the box are visible and interfere with the decor of the room in which the bed is situated. The user may also have a feeling of being closed in, because in the down position the user's head is enclosed between the side walls and top wall of the box. In addition, the mounting arrangements for such beds are complex and difficult to install because the partitions of the walls are generally lightweight and not very thick. Further, these arrangements are completely unsuitable for installing anywhere other than against a wall.

To solve these problems, document FR-A-2 711 048 provides a mounting arrangement for a foldaway bed that does not require the use of a supporting structure. The arrangement is composed of two independent elements arranged on either side of the head of the foldaway bed and comprising wall and/or floor fixing means in the form of a bracket with reinforcing walls. It is thus possible to fix the mounting arrangement either to the floor only or to both the floor and wall. Each reinforcing wall includes a housing to accommodate the hinge pin of the bed.

However, for better use, these two bracket elements have to be fixed to adjoining furniture, such as bedside tables, since the two elements tend otherwise to sag out under the weight of the bed or in response to the various stresses as the foldaway bed is rotated. The main disadvantage of this arrangement is therefore that the hinge pin may come loose and the bed may drop down between the two bracket elements.

Furthermore, this mounting system has poor resistance to deformation: when the bed is pivoted, stresses give rise to a phenomenon of dislodgement of the arrangement due to the effect of the lever arm created by the weight and length of the bed.

SUMMARY OF THE INVENTION

It is an object of the invention to solve these problems and its subject is a collapsible furniture structure, particularly a foldaway bed, comprising a support having two parallel side boards that are set a distance apart, are of approximately rectangular shape, and have two bottom corners, front and rear, and top corners, front and rear, and a pivoting frame, of approximately rectangular shape, that has a rear end part engaged between said side boards and that pivots on these side boards between an approximately vertical folded position and an approximately horizontal down position in which it is opened in the forward direction.

According to the invention, this structure comprises at least one crossmember approximately perpendicular to and fixed to said side boards and intended to be in contact with the floor or with a wall and comprising means for fixing it to the floor or to the wall; a transverse hinge pin extending approximately perpendicularly to said side boards and mounted on said frame, its ends pivoting on said side boards in an area close to their front top corners; and a transverse anti-torsion reinforcing bar approximately perpendicular to and connected to said side boards and located in an area situated underneath said hinge pin.

According to the invention, said structure may comprise at least two mutually parallel crossmembers approximately perpendicular to said side boards, one crossmember being intended to be in contact with the floor and the other intended to be in contact with a wall, these crossmembers comprising means for fixing them to the floor and to the wall.

According to the invention, said structure could also comprise, connected to the side boards, three crossmembers that are approximately parallel to each other and approximately perpendicular to said side boards, said crossmembers being fixed to the side boards at their two bottom corners and at the rear top corner and comprising means for fixing them to the floor and to the wall.

According to the invention, said transverse hinge pin preferably extends from one side board to the other.

According to the invention, said transverse hinge pin preferably extends through a transverse sleeve connected to the pivoting frame.

According to the invention, said transverse reinforcing bar is preferably provided with at least one stop for stopping said pivoting frame in its folded position.

According to the invention, said stop preferably comprises means for setting the folded position of said pivoting frame.

According to the invention, said pivoting frame preferably extends toward the rear past said transverse hinge pin.

According to the invention, said structure preferably comprises power-assisted equipment for pivoting said pivoting frame, said equipment being installed between this frame and said transverse reinforcing bar.

According to the invention, said structure may advantageously comprise bottom enclosing flanking boards fixed to and covering the outer faces of said side boards, and said frame may advantageously be provided with an enclosing box comprising side walls and a front wall which faces the floor when said frame is in its down position, the rear part of said box being engaged between said bottom enclosing flanking boards in such a way that said side walls extend close to these bottom enclosing flanking boards.

According to the invention, when said frame is in its folded position, the side edges where the side walls and said front wall meet are preferably close to the front edges of said bottom enclosing flanking boards.

According to the invention, said structure may advantageously comprise a bottom front baseboard connecting the front bottom edges of said bottom enclosing flanking boards, said front wall having a rear edge situated close to the top edge of said front baseboard when said frame is in its folded position.

According to the invention, said structure may advantageously comprise top enclosing flanking boards continuing upward from said bottom enclosing flanking boards and having front edges set back compared with the front edges of said bottom enclosing flanking boards, said side walls fitted to said frame engaging partly between and close to said top enclosing flanking boards when said frame is in its folded position.

According to the invention, said structure may advantageously comprise a rear enclosing wall extending between said enclosing flanking boards, said frame being fitted with a rear wall whose top edge is close to the bottom edge of this rear enclosing wall when said frame is in its down position.

According to the invention, said structure may advantageously comprise a front wall connecting together the front edges of said side walls and of said front wall, its top edge being close to said rear enclosing wall when said frame is in its down position.

BRIEF DESCRIPTION OF THE DRAWINGS

One particular embodiment of the present invention will now be described by way of non-restrictive example illustrated in the drawing, in which.

DETAILED DESCRIPTION OF EMBODIMENTS

Figure 1:
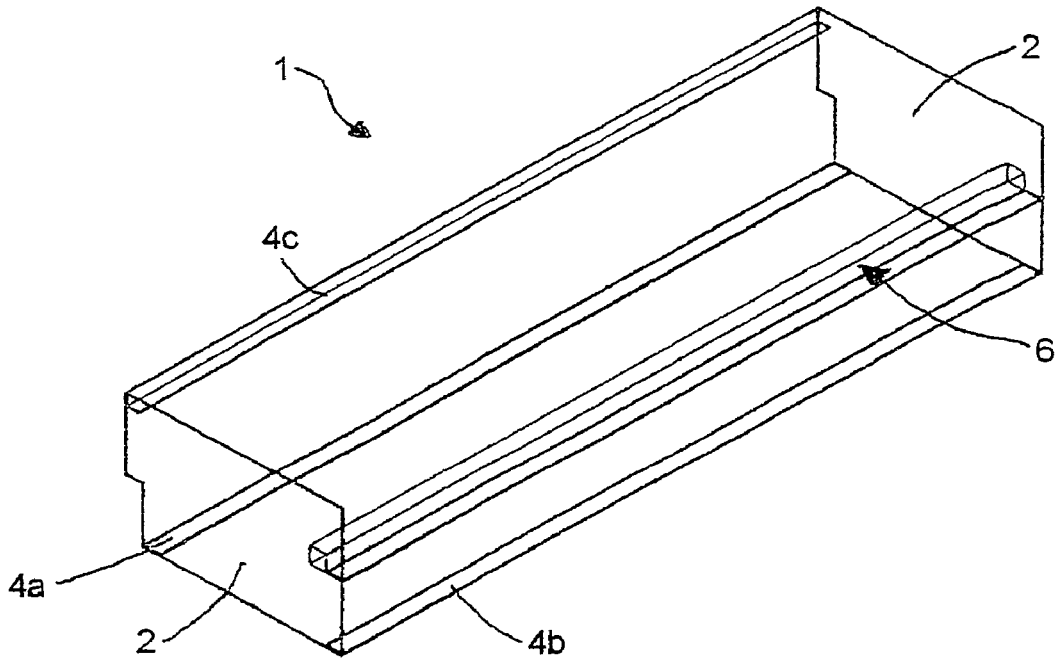
FIG. 1 is a perspective view comprising of a support for a structure according to the invention, before fitting it with a pivoting frame for a foldaway bed.

The folding bed structure 100 shown in the figures, which includes a mounting and hinging arrangement, comprises a support 1 comprising two parallel side boards 2 of approximately rectangular shape. The boards 2 are separated by a distance approximately equal to the width of the pivoting frame 3 of a foldaway bed mounted on the support 1 so as to pivot between an approximately vertical folded position, shown in FIGS. 2 and 4, and an approximately horizontal open or down position, shown in FIGS. 3 and 5.

The support 1 possesses three crossmembers 4 approximately parallel to each other and approximately perpendicular to the boards 2, having means of fixing the support 1 to the wall and to the floor.

Two crossmembers 4*a*, 4*b* are fixed to the boards 2 at their two bottom corners, rear and front, designed to be in contact with the floor, and one crossmember 4*c* is fixed to a rear top corner of the boards 2 designed to be in contact with the wall. The crossmember 4*c* is preferably L-sectioned to increase its resistance to deformation.

The crossmembers 4*a* and 4*b* are preferably of flat section to optimize their contact with the floor. The crossmembers 4 contain fixing holes (not shown) distributed, optionally uniformly, all the way along their length to enable support 1 to be fastened, for example by screws, to the floor and/or to the wall, avoiding possible obstacles such as holes or pipes.

The mounting and hinging arrangement of the structure 100 also includes a hinge pin 5 (not shown in FIG. 1) approximately perpendicular to the boards 2 and mounted both to the pivoting frame 3 and to the boards 2 in an area close to the top front corner of the boards 2.

Figure 10:
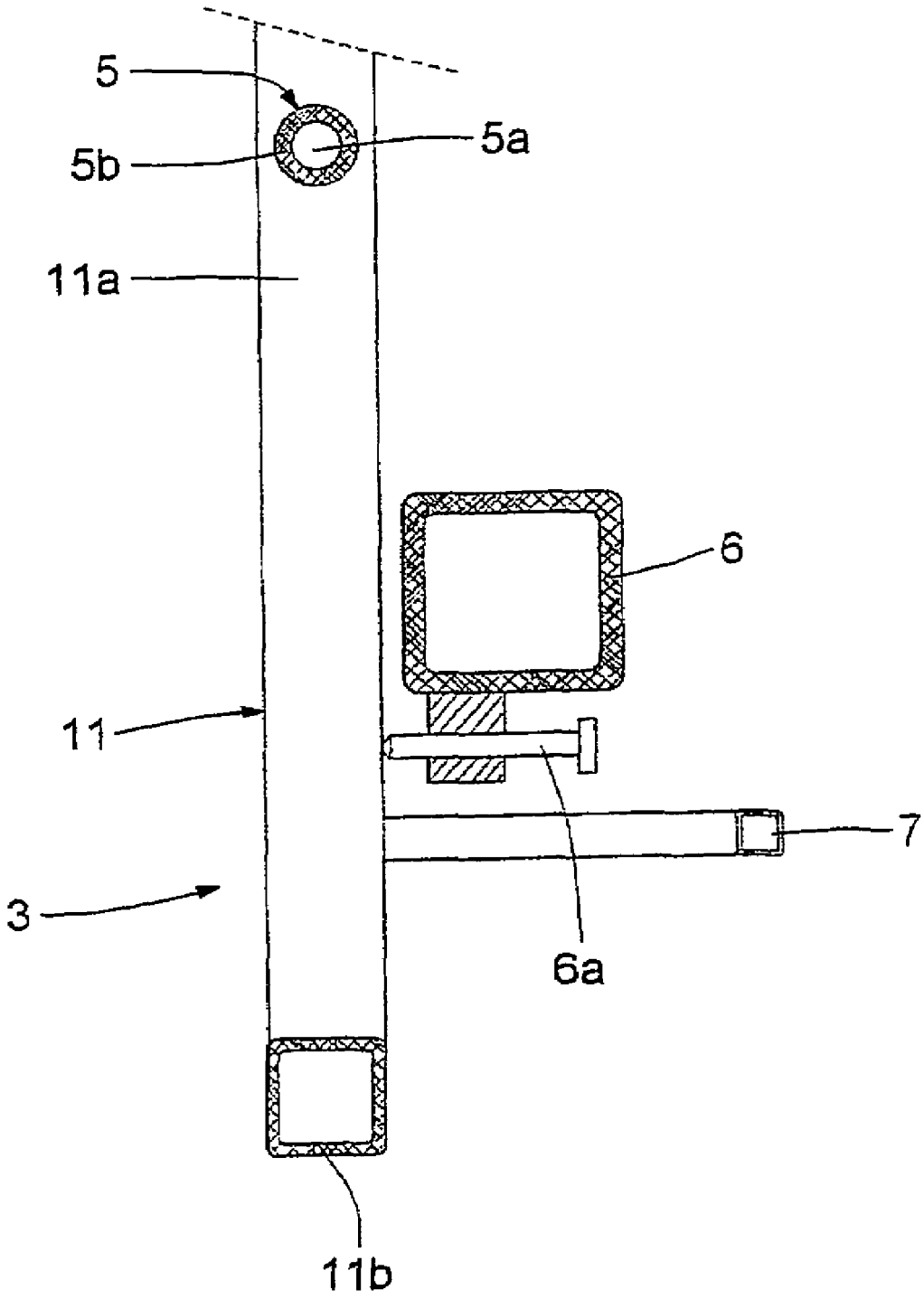
FIG. 10 is an enlarged section through the bottom part of the aforementioned structure.

As FIG. 10 shows, the hinge pin 5 is preferably a bar 5*a* of circular section with a diameter of about, for example, 20 mm to 25 mm, extending from one board to the other with its ends mounted rotatably to the boards 2, optionally with intermediate rings fitted. This bar 5*a* preferably runs through a circular-section sleeve 5*b* fixed firmly to the pivoting frame 3 and extending the full width of the latter.

Figure 2:
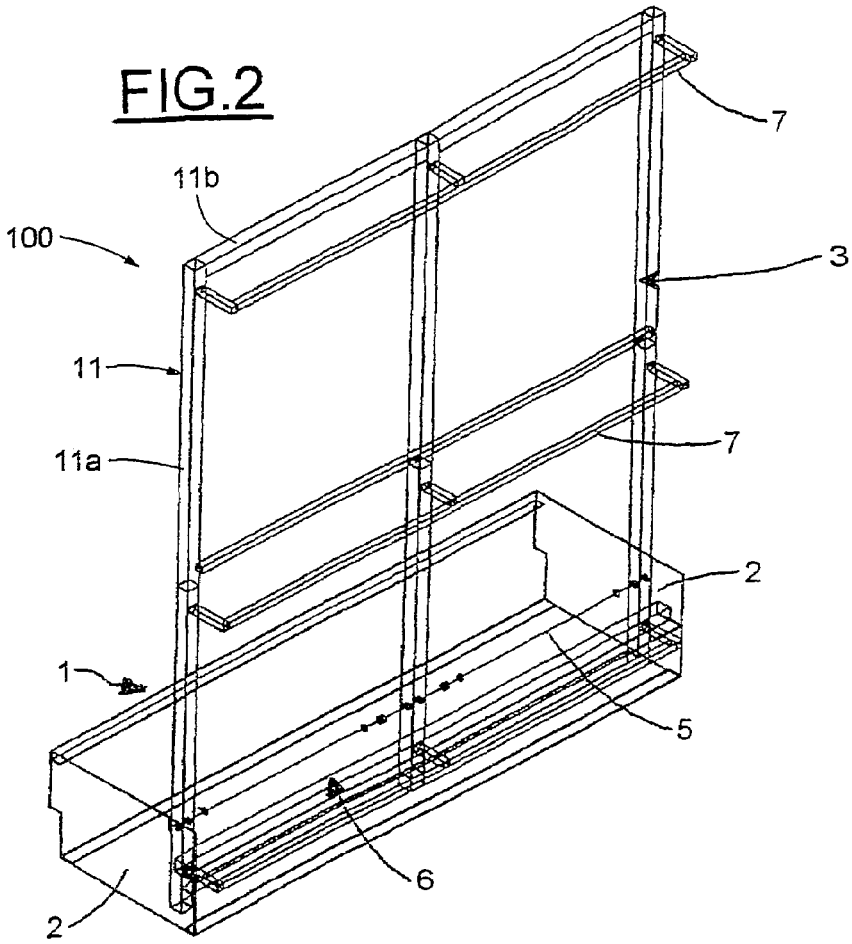
FIGS. 2 and 3 are two perspective views of a structure according to the invention comprising the support seen in FIG. 1 equipped with the pivoting frame, in the folded or vertical position and in the open or down position, respectively.
Figure 3:
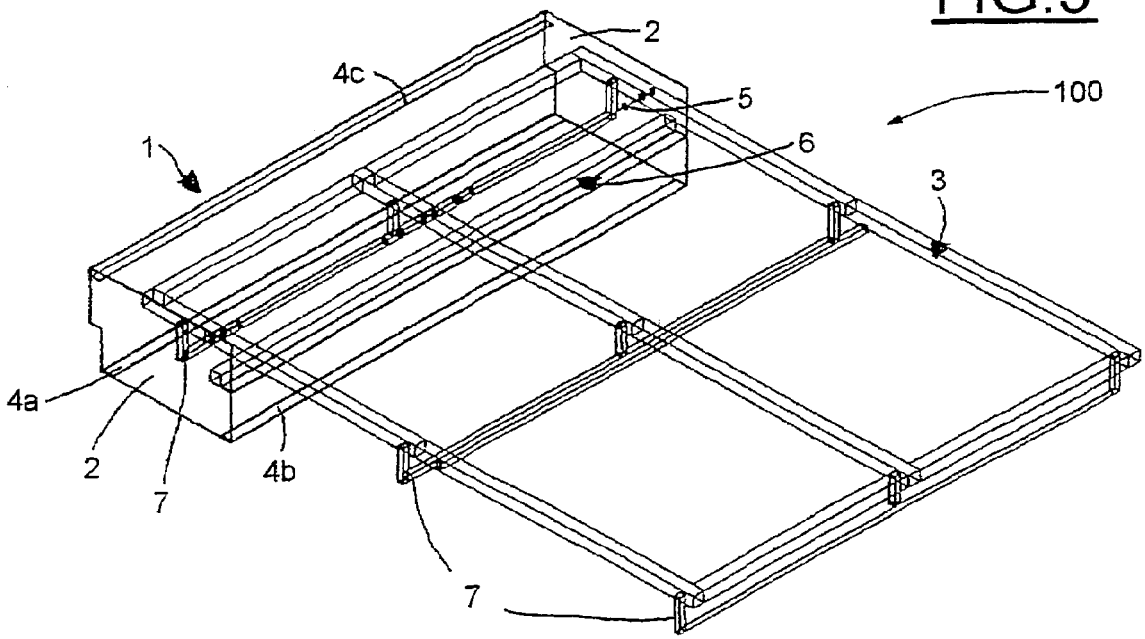

The support 1 also comprises, connected to the boards 2, a transverse anti-torsion reinforcing bar 6 approximately parallel both to the crossmembers 4 and to the transverse hinge pin 5 and located in an area situated underneath the hinge pin 5. The function of the reinforcing bar 6 is, among other things, to reinforce the support 1, especially when the frame 3 is pivoted, and to act as a stop for additional parts of the frame 3 in the folded position (FIG. 2).

The pivoting frame 3 comprises, among other things, bottom bars 7 for supporting optional enclosing means for the pivoting frame 3. The bars 7 are positioned approximately at the two ends and in the middle of the frame 3.

Figure 4:
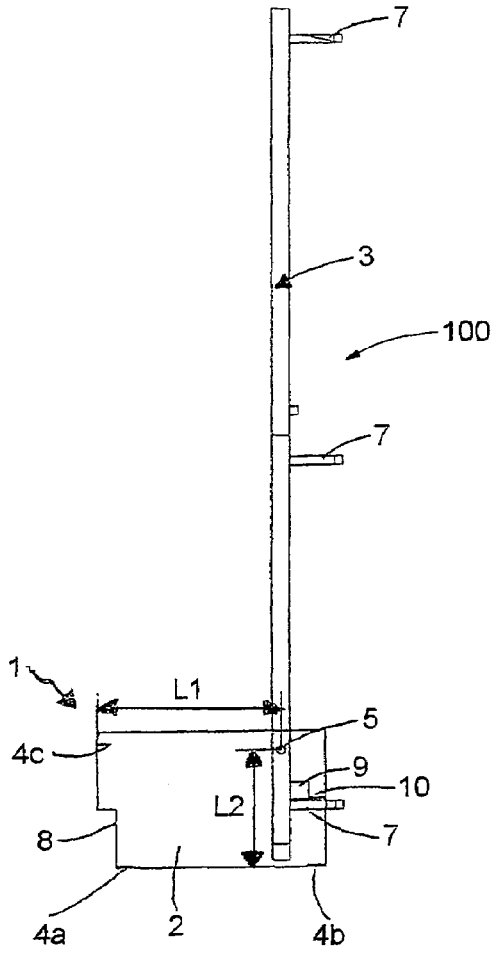
FIGS. 4 and 5 show, in cross section from the side, the structure seen in FIGS. 2 and 3.
Figure 5:
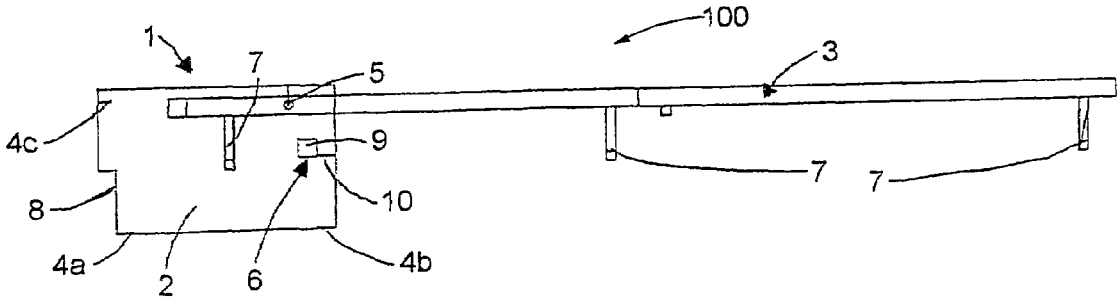

As shown in FIGS. 4 and 5, each board 2 preferably comprises a recess 8 situated underneath its first top corner. The dimensions of the recesses 8 are adapted to the dimensions of a baseboard, whatever its height and thickness. This particular feature allows better fixing of the support 1 against the wall and improves the stability of the arrangement when the frame 3 is pivoted, especially if the floor is not perfectly flat.

In an example of an embodiment, the corresponding end of the hinge pin 5 is situated preferably at a distance L1 of about 500 mm from the rear side of the boards 2 which is perpendicular to the floor and may be intended to come into contact with the wall, and at a distance L2 of about 270 mm from the bottom side of the board 2 which is intended to be in contact with the floor. Such a position, given as an example, for the hinge pin 5 prevents any dislodgement caused by the pivoting of the frame 3 of the foldaway bed. The reasoning behind this is that the frame 3 of the folding bed is relatively long and this length creates a long lever arm when the frame 3 is pivoted. To attenuate this risk of dislodgement, the support 1 must be securely fixed to the floor and/or to the wall and the position of the hinge pin 5 must be appropriate.

The reinforcing bar 6 is situated underneath and slightly forward of the hinge pin 5 (FIGS. 4 and 5). This position of the reinforcing bar 6 relative to the hinge pin 5 is chosen in order to optimize the resistance to dislodgement. The hinge pin 5 is preferably comparatively close to the reinforcing bar 6 and these two parts are relatively close to the floor. The center of gravity of the arrangement made up of the support 1 and the pivoting frame 3 is therefore relatively low, which improves the resistance to dislodgement.

As an example, the first section 9 is preferably continued parallel to the floor by a stiffening section 10, also of steel, of flat section and about 50 mm long. The two sections 9 and 10 of the reinforcing bar 6 are thus so shaped as to fit the shape of the frame 3 and of the support bars 7 when the frame is pivoted as far as it will go against the reinforcing bar 6 in the folded position (FIG. 4).

The main functions of the reinforcing bar 6 are to strengthen the support 1 and provide a stop for the frame 3 in the folded position. It also has the function of preventing the frame 3 dropping down in the event of sudden breakage of the hinge pin 5, which could cause the frame 3 to collapse.

The fact that the hinge pin 5 is connected both to the support 1 and to the pivoting frame 3 ensures good resistance to deformation, particularly if the structure is fitted with automated power-assisted pivoting equipment.

The structure absorbs all the forces produced by the rotation of the frame 3 about the hinge pin 5, so there is no need to install a loadbearing structure. This results in valuable advantages in terms of cost, space requirements and esthetics.

With the mounting and hinging arrangement described above, there is no need to provide a loadbearing structure or associated furniture items. The support 1 of the arrangement is fixed directly to the wall and/or to the floor. It is thus possible to install it anywhere in a room and the presence of a wall is not necessary.

Also, when the foldaway bed is in the down or prone position, i.e. when it is swung down, there is nothing to distinguish it from a conventional fixed bed. The space requirements of the foldaway bed are the same as the dimensions of the bed itself, and therefore the space available in the room in which the bed is installed can be used to its best advantage. Furthermore, it is possible to provide enclosing means for the pivoting frame 3 and the support 1 so that when it is in the folded position the various parts blend in with the décor of the room in which the bed is installed.

The frame 3 comprises an approximately rectangular subframe 11 consisting of side bars 11*a* and rear and front bars 11*b* and inner bars forming a cross 12 connected to the bars 11*a* and 11*b*.

The hinge pin 5 is connected to the pivoting frame 3 at a distance from its rear end so that the pivoting frame 3 extends rearward beyond the hinge pin 5.

The structure 100 may also include automated power-assisted equipment for pivoting the pivoting frame 3, such as cylinders or electric motors, in which case the reinforcing bar 6 can also be used as a support for these automated means because it is stiff enough to take loads of around 250 kg/cm$^2$. Such automated means are then preferably fixed between the stiffening section 10 of the reinforcing bar 6 and the pivoting frame 3.

Figure 6:
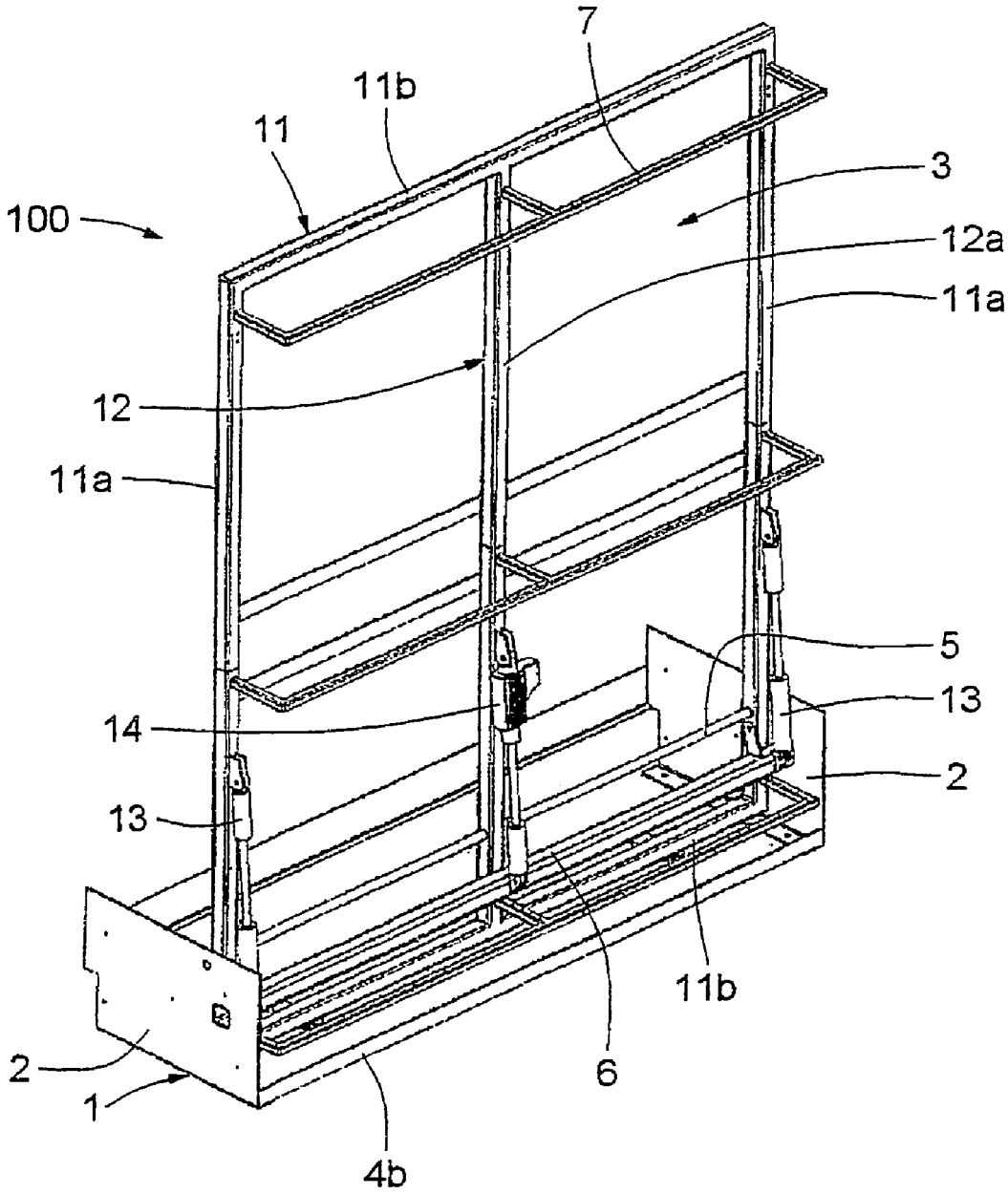
FIGS. 6 and 7 are two perspective views of said structure according to the invention equipped with operating means, in the folded or vertical position and in the open or down position, respectively.
Figure 7:
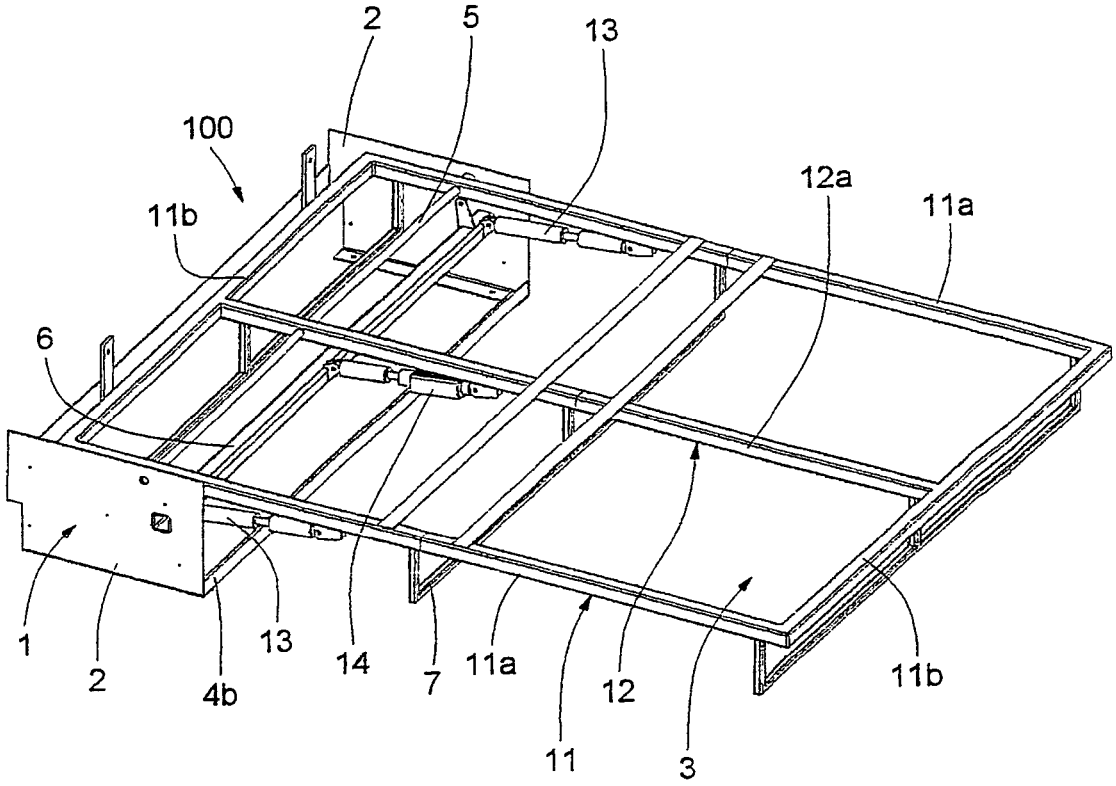

As FIGS. 6 and 7 show in particular, lateral pneumatic power-assistance cylinders 13 are installed between the reinforcing bar 6 and the side bars 11*a* of the subframe 11, and a user-controllable operating cylinder 14 is installed between the middle of the reinforcing bar 6 and the central bar 12*a* of the cross 12 parallel to the side bars 11*a*.

As FIG. 10 shows, a setting screw 6*a* is connected to the transverse reinforcing bar 6 to act as an end-of-travel stop for the raised position of the frame 3 and to allow the final vertical position of the frame 3 in the folded position to be adjusted.

In a variant, the final vertical folded position of the frame 3 could be set by adjusting the length of the aforementioned cylinders, using for example screw-nut systems.

Figure 8:
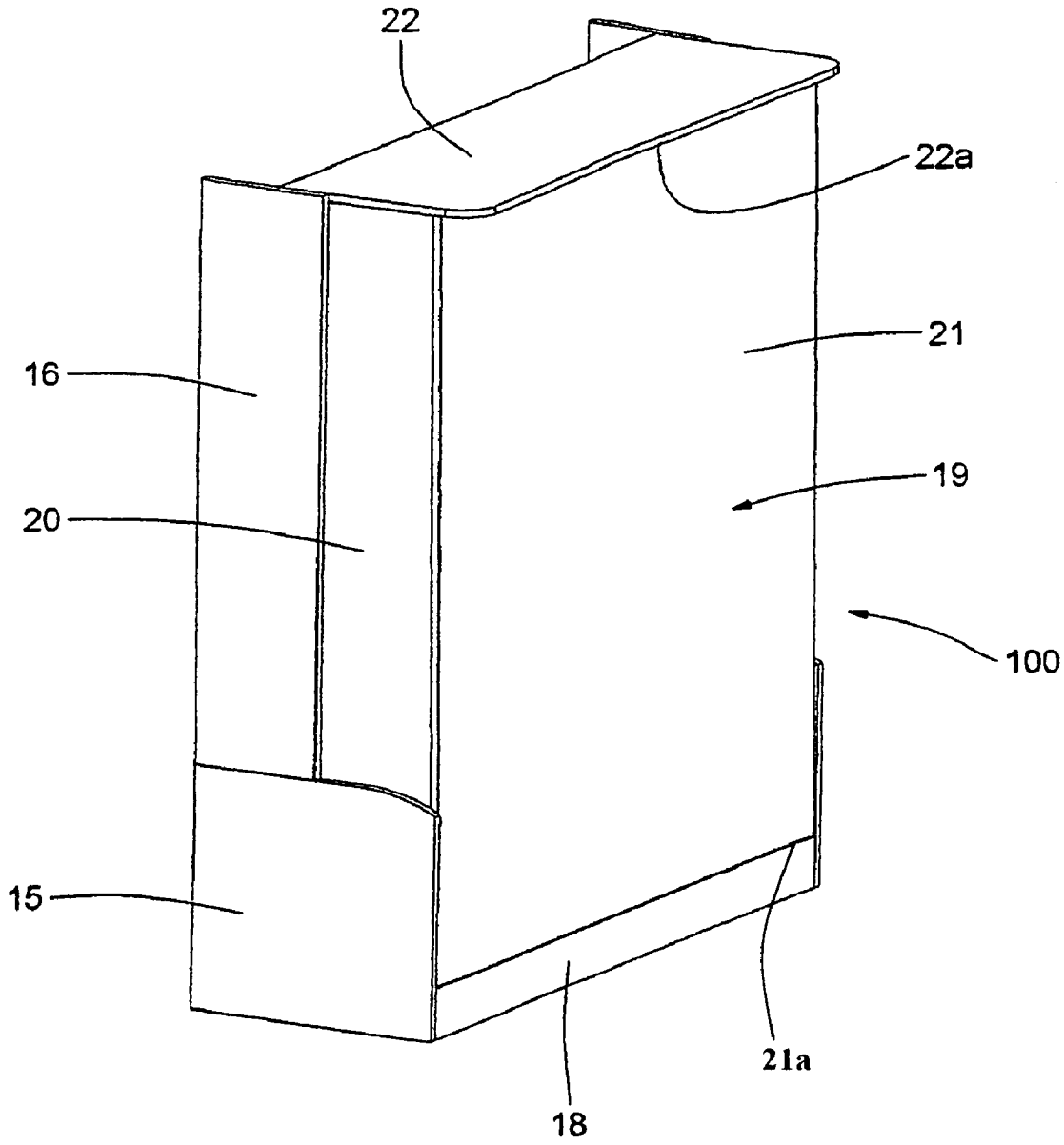
FIGS. 8 and 9 are two perspective views of said structure according to the invention equipped with enclosing means, in the folded or vertical position and in the open or down position, respectively.
Figure 9:
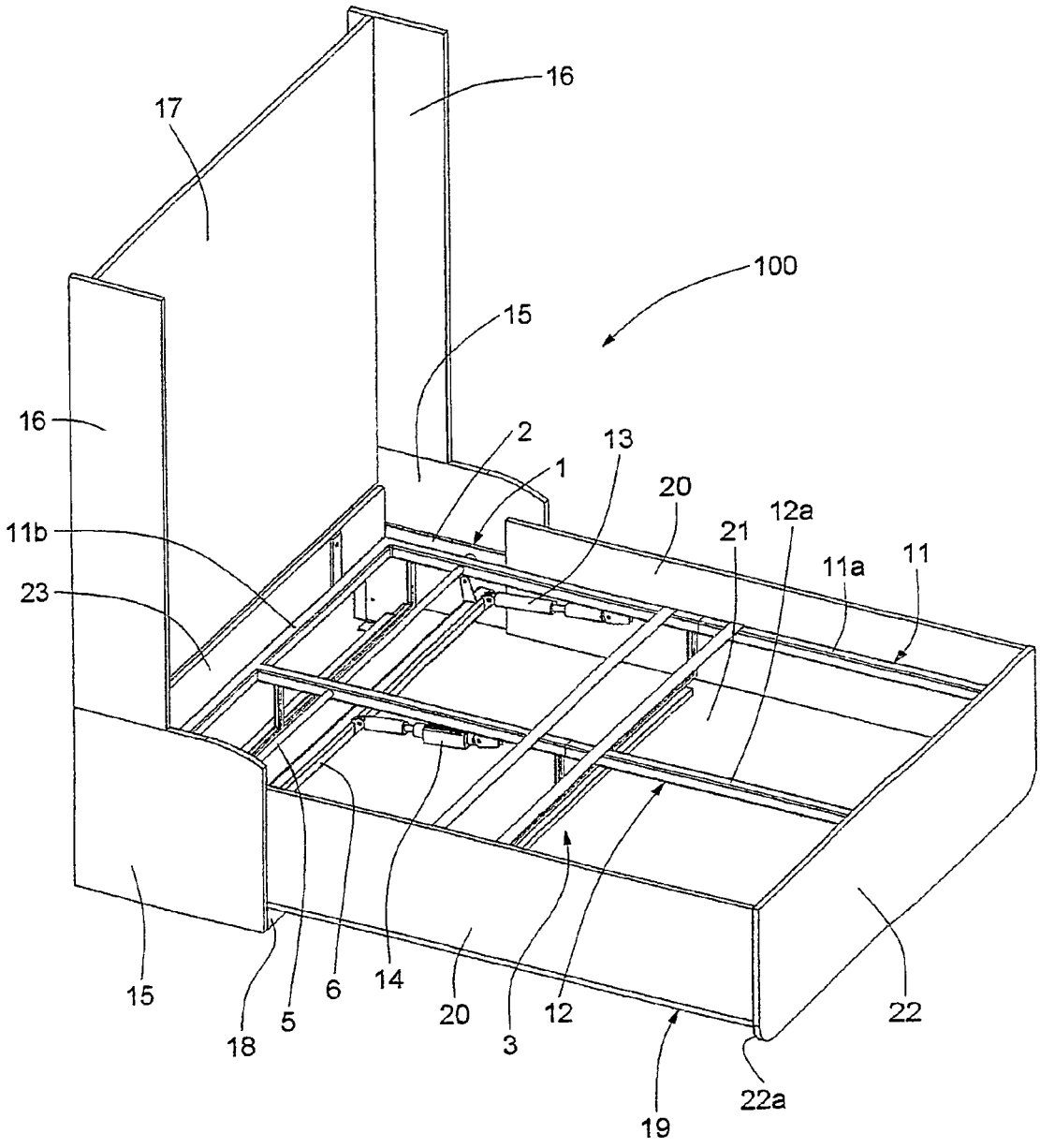

Turning to FIGS. 8 and 9, it can be seen that the structure 100 can also include special fixed enclosing means described below.

Bottom side flanking boards 16 of approximately rectangular shape and extending further both upward and forward are fixed to the outer faces of the side boards 2. The side boards 2 could be inserted in suitable housings in the flanking boards 16.

The bottom side flanking boards 15 are continued in the upward direction by top side flanking boards 16, the vertical front edges of which are set back toward the rear compared with the vertical front edges of the bottom flanking boards 15.

A transverse vertical rear wall 17 connects the side flanking boards 15 and 16, this rear wall 17 being set back toward the rear compared with the vertical front edges of the top side flanking boards 16 and slightly forward of their vertical rear edges.

A front transverse baseboard 18 connects the bottom parts of the front edges of the bottom flanking boards 15.

The structure 100 may also include movable enclosing means described below.

The frame 3 is provided with an enclosing box 19 that includes side walls 20; a front wall 21, which lies face to the floor when the frame is in its down position, and that is fixed to the bars 7 of the frame 3 to create a space between the subframe 11 and the front wall 21 in which to house the cylinders 13 and 14; and a front transverse wall 22 on the front free end of the frame 3; and a rear transverse wall 23 at the rear free end of the frame 3. The front wall 22 is continued downward to provide a foot 22*a* that rests on the floor when the frame 3 is down.

The rear parts of the side walls 20 are engaged between and close to the side boards 2 of the support 1 and have rear edges coming close to the reinforcing bar 6 when the frame is in its down position.

The rear part of the front wall 21 is also engaged between the side boards 2 of the support 1 and passes underneath the reinforcing bar 6 when the frame is in its down position.

The side walls 20, the front transverse wall 22 and the transverse rear wall 23 rise above the subframe 11 to extend around the sides of a bed base and mattress installed on the subframe 11. When the frame 3 is in its down position, the top edges of the side walls 20 are slightly below the top edges of the bottom flanking boards 15.

When the frame 3 is set in its folded, vertical position, the side walls 20 of its enclosing means partly engage between the top flanking boards 16, the front wall 21 is close to the front edges of the bottom flanking boards 25, the bottom rear edge 21*a* of the front wall 21 is close to the top edge of the transverse baseboard 18 and the top edge of the rear transverse wall 23 is close to the bottom edge of the fixed rear transverse wall 17.

As can be seen in FIG. 8, when the frame 3 is in its vertical position, the enclosing means described above gives the appearance of a wardrobe enclosing both it and its bedding.

As can be seen in FIG. 9, when the frame 3 is in its down position, the described enclosing means confines the perimeter of the bedding, and the lesser width of the top flanking boards 16 is no inconvenience to the users.

The structure 100 described above can be applied to build a bed in which the lengthwise direction, and therefore the sleeping direction, can perfectly well run either perpendicular to the hinge pin 5 or parallel to it.

The bottom flanking boards 15 and top flanking boards 16 may also advantageously form walls for items of furniture or storage shelving on either side of the structure 100.

This invention is not limited to the particular illustrative embodiments described above. Many variants are possible without departing from the scope of the accompanying claims.

The invention claimed is:

1. A collapsible furniture structure, comprising:

a support having two parallel side boards that are set a distance apart, that are of approximately rectangular shape, and have two bottom corners, front and rear, and two top corners, front and rear;

a pivoting frame, of approximately rectangular shape, that has a rear end part engaged between said side boards and that pivots on said side boards between an approximately vertical folded position and an approximately horizontal down position in which the frame is opened in the forward direction;

at least one crossmember perpendicular to and fixed to said side boards and intended to be in contact with a floor or with a wall and comprising means for fixing said at least one crossmember to the floor or to the wall;

a transverse hinge pin extending perpendicularly to said side boards and mounted on said frame, ends of said hinge pin pivoting on said side boards in an area close to said front top corners, said pivoting frame extending towards the rear past said hinge pin;

and a transverse anti-torsion reinforcing bar perpendicular to and connected to said side boards and located in an area situated underneath, adjacent to and slightly forward of said hinge pin so as to optimize the resistance, to form an end-of-travel stop for the pivoting frame when the frame is in the folded position and to prevent the pivoting frame dropping down when the frame is in the down position.

2. The structure as claimed in claim 1, further comprising at least two mutually parallel crossmembers approximately perpendicular to said side boards, one crossmember being intended to be in contact with the floor and the other intended to be in contact with a wall, said crossmembers comprising means for fixing said crossmembers to the floor and to the wall.

3. The structure as claimed in claim 1, further comprising, connected to the side boards, three crossmembers that are approximately parallel to each other and approximately perpendicular to said side boards, said crossmembers being fixed to the side boards at the two bottom corners of the side boards and at the rear top corner and comprising means for fixing said crossmembers to the floor and to the wall.

4. The structure as claimed in claim 1, wherein said transverse hinge pin extends from one side board to the other.

5. The structure as claimed in claim 4, wherein said transverse hinge pin extends through a transverse sleeve connected to the pivoting frame.

6. The structure as claimed in claim 1, wherein said transverse reinforcing bar is provided with at least one stop for stopping said pivoting frame in the folded position.

7. The structure as claimed in claim 1, further comprising means for setting the folded position of said pivoting frame.

8. The structure as claimed in claim 1, further comprising power-assisted equipment for pivoting said pivoting frame, said equipment being installed between said frame and said transverse reinforcing bar.

9. The structure as claimed in claim 1, further comprising bottom enclosing flanking boards fixed to and covering the outer faces of said side boards, and wherein said frame is provided with an enclosing box comprising side walls and a front wall which faces the floor when said frame is in the down position, the rear part of said box being engaged between said bottom enclosing flanking boards in such a way that said side walls extend close to the bottom enclosing flanking boards.

10. The structure as claimed in claim 9, wherein, when said frame is in the folded position, the side edges where the side walls and said front wall meet are close to the front edges of said bottom enclosing flanking boards.

11. The structure as claimed in claim 10, further comprising a bottom front baseboard connecting the front bottom edges of said bottom enclosing flanking boards, said front wall having a rear edge situated close to the top edge of said bottom front baseboard when said frame is in the folded position.

12. The structure as claimed in claim 10, further comprising top enclosing flanking boards continuing upward from said bottom enclosing flanking boards and having front edges set back compared with the front edges of said bottom enclosing flanking boards, said side walls fitted to said frame engaging partly between and close to said top enclosing flanking boards when said frame is in the folded position.

13. The structure as claimed in claim 10, further comprising a rear enclosing wall extending between said enclosing flanking boards, said frame being fitted with a rear wall whose top edge is close to the bottom edge of the rear enclosing wall when said frame is in the down position.

14. The structure as claimed in claim 9, further comprising a bottom front baseboard connecting the front bottom edges of said bottom enclosing flanking boards, said front wall having a rear edge situated close to the top edge of said bottom front baseboard when said frame is in the folded position.

15. The structure as claimed in claim 14, further comprising top enclosing flanking boards continuing upward from said bottom enclosing flanking boards and having front edges set back compared with the front edges of said bottom enclosing flanking boards, said side walls fitted to said frame engaging partly between and close to said top enclosing flanking boards when said frame is in the folded position.

16. The structure as claimed in claim 14, further comprising a rear enclosing wall extending between said enclosing flanking boards, said frame being fitted with a rear wall whose top edge is close to the bottom edge of the rear enclosing wall when said frame is in the down position.

17. The structure as claimed in claim 9, further comprising top enclosing flanking boards continuing upward from said bottom enclosing flanking boards and having front edges set back compared with the front edges of said bottom enclosing flanking boards, said side walls fitted to said frame engaging partly between and close to said top enclosing flanking boards when said frame is in the folded position.

18. The structure as claimed in claim 9, further comprising a rear enclosing wall extending between said enclosing flanking boards, said frame being fitted with a rear wall whose top edge is close to the bottom edge of the rear enclosing wall when said frame is in the down position.

19. The structure as claimed in claim 18, wherein said box comprises a front wall connecting together the front edges of said side walls and of said front wall, a top edge of said front wall being close to said rear enclosing wall.

20. A collapsible furniture structure, comprising:

a support having two parallel spaced apart side boards;

a pivoting frame having a rear end part engaged between said side boards and that pivots on said side boards between an approximately vertical folded position and an approximately horizontal down position;

a crossmember perpendicular to and fixed to said side boards and configured to be in contact with a floor or with a wall and comprising means for fixing the crossmember to the floor or to the wall;

a transverse hinge pin extending perpendicularly to said side boards and mounted on said pivoting frame, ends of said hinge pin pivoting on said side boards adjacent to front top corners of said side boards; and a transverse anti-torsion reinforcing bar perpendicular to and fixed to said side boards, the transverse anti-torsion reinforcing bar being located underneath, adjacent to and forward of the hinge pin to form an end-of-travel stop for the pivoting frame when the pivoting frame is in the folded position and to prevent the pivoting frame dropping below the down position.

* * * * *

UNITED STATES PATENT AND TRADEMARK OFFICE

CERTIFICATE OF CORRECTION

PATENT NO. : 7,631,374 B2
APPLICATION NO. : 10/592069
DATED : December 15, 2009
INVENTOR(S) : Alexis Paoutoff It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 320 days.

Signed and Sealed this

Twenty-first Day of December, 2010

David J. Kappos

David J. Kappos
*Director of the United States Patent and Trademark Office*